United States Patent [19]

Chance et al.

[11] Patent Number: 4,900,324

[45] Date of Patent: Feb. 13, 1990

[54] AGENTS FOR NON-FORMALDEHYDE DURABLE PRESS FINISHING AND TEXTILE PRODUCTS THEREFROM

[75] Inventors: Leon H. Chance; Gary F. Danna; Bethlehem K. Andrews, all of New Orleans, La.

[73] Assignee: The United States of America, as represented by the Secretary of Agriculture, Washington, D.C.

[21] Appl. No.: 229,420

[22] Filed: Aug. 8, 1988

Related U.S. Application Data

[63] Continuation-in-part of Ser. No. 50,436, May 18, 1987, Pat. No. 4,818,243.

[51] Int. Cl.[4] ..... C07C 43/30; C07C 43/303; C08B 11/02; C08B 11/193

[52] U.S. Cl. ..... 8/116.4; 536/95; 549/476; 568/603

[58] Field of Search ..... 536/95; 568/603; 549/476; 8/116.4

[56] References Cited

U.S. PATENT DOCUMENTS

| | | | |
|---|---|---|---|
| 2,207,740 | 7/1940 | Kaase et al. | 8/113 |
| 2,350,350 | 6/1944 | Gresham et al. | 260/615 |
| 2,360,477 | 10/1944 | Dahl | 536/95 |
| 2,548,455 | 4/1951 | Walker et al. | 260/233.3 |
| 2,644,013 | 6/1953 | Barth | 536/95 |
| 2,748,147 | 5/1956 | Clauson-Kaas | 260/347.4 |
| 2,785,947 | 3/1957 | Kress et al. | 8/116 |
| 2,785,948 | 3/1957 | Abrams | 536/95 |
| 2,785,949 | 3/1957 | Kress | 8/110 |
| 2,785,996 | 3/1957 | Kress | 117/139.4 |
| 2,786,081 | 3/1957 | Kress | 260/615 |
| 4,818,243 | 4/1989 | Chance et al. | 8/116.4 |

OTHER PUBLICATIONS

Irvin et al., *Textile Res. J.,* Feb., 1958, pp. 148–158.

J. G. Frick, Jr., "Bonding in Cotton Fiber from Formaldehyde-Free Crosslinks," J. Appl. Polym. Sci. 30: 3467–3477 (1985) [SRRC #7329].

J. G. Frick, Jr. et al., "Acetals as Crosslinking Reagents for Cotton," J. Appl. Polym. Sci., 29: 1433–1447 (1984) [SRRC #7170].

E. J. Witzeman et al., "dl-Glyceraldehyde Diethyl Acetal," Organic Synthesis, vol. II: 307–308 (1943).

ASTM Standard D 1295-67, "Wrinkle Recovery of Woven Textile Fabrics Using the Vertical Strip Apparatus," 1977 Annual Book of ASTM Standards pp. 216–219 (Part 32), American Society for Testing and Materials, Phila., PA.

*Primary Examiner*—James C. Cannon

*Attorney, Agent, or Firm*—M. Howard Silverstein; John D. Fado; Mervin E. Brokke

[57] ABSTRACT

The acetals, 2,3-dihydroxy-1,1,4,4-tetramethoxybutane, 3,4-dihydroxy-2,5-dimethoxytetrahydrofuran, and glyceraldehyde dimethylacetal, when applied to cotton fabric by conventional pad-dry-cure procedures using special combined acid catalysts, were found to crosslink cellulose hydroxy groups at a very rapid rate (e.g., 20 seconds at 160° C.), thereby imparting improved wrinkle recovery in the range of that required for durable press finishing. Cotton fabrics treated with these acetals have the advantage of no formaldehyde release.

15 Claims, No Drawings

AGENTS FOR NON-FORMALDEHYDE DURABLE PRESS FINISHING AND TEXTILE PRODUCTS THEREFROM

CROSS REFERENCE TO RELATED APPLICATION

This is a continuation-in-part of Ser. No. 50,436 filed May 18, 1987, now U.S. Pat. No. 4,818,243.

BACKGROUND OF THE INVENTION

1. Field of the Invention

This invention relates to crosslinking of cellulosic materials to produce fabrics with wrinkle recovery properties required for durable press finishes.

2. Description of the Prior Art

J. F. Walker [U.S. Pat. No. 2,548,455 (1951)] described the use of acetals for crosslinking cellulosic materials to produce improved wrinkle recovery. He reported crosslinking of paper, starch, regenerated cellulose, and cotton with 2,5-dimethoxytetrahydrofuran. However, his process required curing for 15 min at 140°C. Although Walker used 2,5-dimethoxytetrahydrofuran, he in effect obtained crosslinking with the dialdehyde, succinaldehyde, which is the hydrolysis product of 2,5-dimethoxytetrohydrofuran formed in the reaction with cellulose.

Frick and Harper [J. G. Frick, Jr. and R. J. Harper, Jr., J. Appl. Polym. Sci. 29: 1433–1447 (1984); and J. G. Harper, Jr., J. Appl. Polym. Sci. 30: 3467–3477 (1985)] found that acetals derived from dialdehydes crosslinked cotton to produce improved wrinkle recovery. The most effective were tetraalkoxy acetals of succinaldehyde and gluteraldehyde applied to cotton from water solutions. They also found that 2,5-dimethoxytetrahydrofuran crosslinked cotton as walker had reported. However, Frick and Harper proposed a different crosslinking mechanism than Walker.

SUMMARY OF THE INVENTION

We have now discovered cellulosic fabrics with improved wrinkle recovery, which are characterized by crosslinks of the following structures:

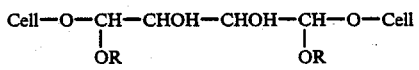

(1)

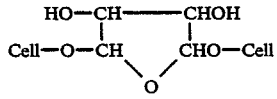

(2)

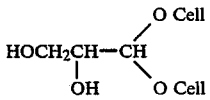

(3)

where "Cell" stands for cellulose and R stands for an alkyl group or cellulose.

In accordance with this discovery, it is an object of the invention to provide a process for treating cellulosic materials with hydroxy derivatives of acetals or with hydroxy derivatives of dialkoxy acetals of dihydrofuran in the presence of special combination catalysts, thereby crosslinking the cellulose at a very rapid rate to produce materials with improved wrinkle recovery.

A further object of the invention is to provide a process for treating cotton fabric with 2,3-dihydroxy-1,1,4,4-tetramethoxybutane in the presence of an acid catalyst and a hydroxy acid activator, thereby producing a fabric with improved wrinkle recovery.

A further object of the invention is to provide a process for treating cotton fabric with 3,4-dihydroxy-2,5-dimethoxytetrahydrofuran in the presence of an acid catalyst and an hydroxy acid activator, thereby producing a fabric with improved wrinkle recovery.

A further object of the invention is to provide a conventional pad-dry-cure process for treating cotton fabric with said acetals, thereby crosslinking the fabric at a very rapid rate in the presence of said catalysts to provide wrinkle-resistant fabrics for use in permanent press textiles, said textiles having the advantages of no release of toxic formaldehyde.

Other objects and advantages of this invention will become obvious from the ensuing description.

DETAILED DESCRIPTION OF THE INVENTION

In this invention hydroxy derivatives of acetal and dialkoxy dihydrofurans are contemplated as agents for crosslinking, thereby improving the wrinkle recovery of cellulose materials.

These reagents have been found to have advantages over prior process for treating cellulose. One advantage lies in the fact that the hydroxy derivatives have high boiling points, which makes it possible to cure cellulosic materials at higher temperatures and shorter reaction times than was possible with more volatile acetals that do not contain hydroxyl groups. Another advantage is that hydroxy acetals are more water soluble and thus more practical for application to cellulosic materials. Another advantage is that the polyfunctional acetals of this invention are more reactive, and thus give higher wrinkle recovery angles when applied to cellulosic textiles than difunctional materials under comparable conditions.

Whereas this invention is primarily concerned with a process for treating cotton fabrics, other cellulosic materials may be used. These include regenerated cellulose, paper, starch, and the cotton in cotton/polyester blends. When the cellulosic material is cotton fabric or a cotton/polyester blend, an improvement in wrinkle recovery is obtained. An improvement in wrinkle recovery is an indication of cellulose crosslinking. Fibers from fabrics treated with hydroxy acetals are insoluble in cupriethylene-diamine dihydroxide, which is an indication of crosslinking. Since these crosslinks form an ether linkage with cellulose, they are resistant to hydrolytic conditions encountered in laundering. In the crosslinking reaction, hydroxy groups of cellulose react with alkoxy groups of acetals, and the corresponding alcohol is eliminated in the process.

Acid catalysts which are suitable for use in this invention are metal salts such as aluminum sulfate, aluminum chlorohydroxide, magnesium chloride, zinc nitrate, and certain organic acids such as p-toluene sulfonic acid. The preferred catalyst is aluminum sulfate. A catalyst activator may be used also in combination with the said catalysts. These activators are from the group consisting of organic hydroxy acids. The preferred hydroxy acids are citric acid and tartaric acid or a combination thereof. Although the acid catalyst may be used alone, it is preferable to use a combination of the catalyst and hydroxy acid activator.

Solutions used in treating cellulosic materials are prepared by dissolving acetal and catalyst in a suitable solvent, such as water. Concentration of acetal may vary over a range from about 5% to20%, and the combined catalyst activator concentration is from about 0.4% to 2.0% on a weight basis, depending on the particular catalyst system selected. In preparing solutions it is advantageous, although not necessary, to use a buffer to help prevent excessive strength loss of fabric due to acid catalyst. An exemplary buffer is a basic aluminum acetate borate of the formula, $Al(OH)_2OAc.1/3H_3BO_3$. It is also advantageous, although not necessary, to add a surface-active agent and a softening agent to the solution to improve wetting of cellulosic material. The pH of the solutions can range from about 2.3 to 6.5 depending on catalyst selected.

Before treating cellulosic material it is important to determine if the material contains any residual alkalinity, since this would neutralize a portion of the catalyst and render the catalyst less effective during treatment. If the material is found to be alkaline, it should be scoured prior to the impregnation step. Scouring is conveniently achieved by passing the material through dilute acetic acid and drying. The cellulosic material is impregnated with acetal solution and any excess solution is removed, preferably by padding. The material may then be cured without a drying step, or it may be dried prior to curing. It is preferable to dry prior to curing at temperatures ranging from about 70° C. to 90° C. for from about 3 to 5 minutes. After drying, the material is cured at approximately 135° C. to 170° C. for about 10 seconds to 3 minutes, the shortest time at the highest temperature.

Acetals of hydroxy compounds that are suitable for this invention include methyl, ethyl, iso-propyl, and tert-butyl acetals. Preferred acetals are 3,4-dihydroxy-2,5-dimethoxytetrahydrofuran, hereinafter referred to as DHMTF, and 2,3-dihydroxy-1,1,4,4-tetramethoxybutane, hereinafter referred to as DHTMB. DHMTF was prepared by aqueous potassium permanganate oxidation of 2,5-dimethoxy-2,5-dihydrofuran as described by John C. Sheehan and Barry M. Bloom [J. Am. Chem. Soc. 74: 3825–3828 (1952)] and by Niels Clauson-Kaas [U.S. Pat. No. 2,748,147 (1956)]. DHTMB was also prepared by aqueous potassium permanganate oxidation of 1,1,4,4-tetramethoxybutene-2 as described by Karl Zeile and Alex Heusner [Chem. Ber. 90: 1869–1870 (1957), Chem. Abstr. 54: 17439d (1960)].

Other suitable acetals are glyceraldehyde diethyl acetal, hereinafter referred to as GDEA, and glyceraldehyde dimethyl acetal, hereinafter referred to as GDMA. The GDEA and GDMA used in this invention are prepared by the aqueous potassium permanganate oxidation of the appropriate acrolein acetal as described in Organic Synthesis, Volume II, pp. 307–308 (1943), the procedure of which is herein incorporated by reference.

It will be obvious to those skilled in the art that other hydroxy acetals will be suitable for this invention. These would include but not be limited to mono-, di-, and polyacetals containing one or more hydroxyl groups.

Fabric samples treated with DHMTF or DHTMB were yellowed during the heat curing process. A probable explanation of this was the presence of impurities in the DHMTF and DHTMB. Nuclear magnetic resonance (NMR) spectra of the compounds indicated the presence of carbonyl groups (presumably aldehydes) as well as impurities containing unsaturated groups. It is believed that pure DHMTF and DHTMB would not cause the fabric to turn yellow. The yellow color could be removed by bleaching with oxidizing agents such as magnesium peroxyphthalate, sodium perborate, hydrogen peroxide, sodium hypochlorite (NaOCl), or hypochlorous acid (HOCl). The reducing agent sodium borohydride was also effective in removing the yellow color. Preferred agents were NaOCl and HOCl, because the color could be removed in about 15 seconds or less to about 60 seconds at ambient room temperature at HOCl or NaOCl concentrations from about 0.05% to 0.10%.

The fabric samples treated according to this invention are bleached and scoured 80×80 cotton printcloth, and these samples are tested for conditioned wrinkle recovery angles (WRA) by the standard method of the American Society for Testing Materials, Philadelphia, PA, 1964 Book of ASTM Standards, designation D1295-60T, herein incorporated by reference. After curing, fabric samples were thoroughly rinsed in hot running tap water and oven dried before testing.

Without desiring to be bound to any particular theory of operation, it is believed that hydroxy derivatives of di- or tetraalkoxy acetals derived from dihydrofurans or from the alkene class of acetals, respectively, react with cellulosic materials to crosslink hydroxy groups, resulting in improved wrinkle recovery.

The following general equations represent how the reaction of cellulose with DHMTF, DHTMB, and GDMA, respectively, proceeds:

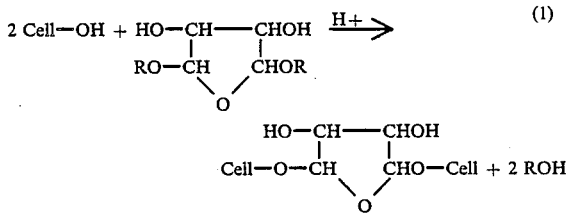

(1)

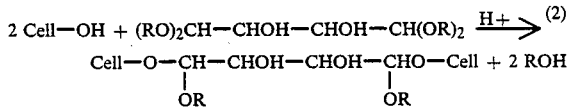

(2)

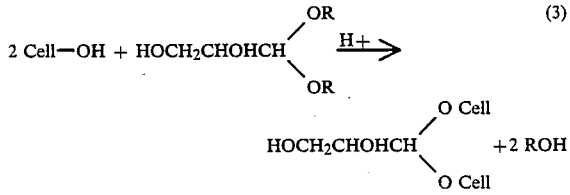

(3)

Where "Cell" stands for cellulose and R stands for an alkyl group or cellulose. In Equation (1) above, another mechanism for the reaction with cellulose should not be ruled out. Under acidic conditions of the reaction, an opening of the tetrahydrofuran ring is possible. Walker described this hydrolysis reaction [U.S. Pat. No. 2,548,455 (1951)]. If ring opening occurs with DHMTF the hydrolysis product would by tartraldehyde, which could not react with cellulose to give a cellulose crosslink similar to that of Equation (2) above. Niels Clauson-Kass [U.S. Pat. No. 2,748,147 (1956)] reported that 2,5-dialkoxy-3,4-dihydroxytetrahydrofurans could be readily hydrolyzed to tartaric dialdehydes.

The following examples are intended only to further illustrate the invention and are not intended to limit the scope of the invention, which is defined by the claims.

EXAMPLE 1

A water solution was prepared containing 10%, 2,3-dihydroxy-1,1,4,4-tetramethoxybutane (DHTMB), 0.76% aluminum sulfate of the formula, $Al_2(SO_4)_3.16H_2O$, 0.76% L-(+)-tartaric acid, 0.3% $Al(OH)_2OAc.1/3\ H_3BO_3$ (aluminum hydroxyacetate borate) as a buffer, and 1% silanol softener. The softener was added to the solution last. Three samples of cotton printcloth was padded with the solution to a wet pick-up of 70–80% using a laboratory padder. The samples were dried for 5 minutes in a forced draft oven at 85° C., and then cured similarly at the time and temperature indicated in Table I. The samples were rinsed in hot tap water, dried in an oven for 5 minutes, and air equilibrated. Weight gain (% add-on) and WRA (warp+fill) are also shown.

All of the treated samples had good WRA, which was in the range required for permanent press fabrics. All of the samples were yellowed by the treatment. The yellow color could by substantially removed by treatment with the agents described in Example 3 and in Table III.

EXAMPLE 2

A water solution was prepared exactly as in Example 1 except that 3,4-dihydroxy-2,5-dimethoxytetrahydrofuran (DHMTF) was used instead of DHTMB. The concentration of DHMTF in the solution was 10%. The solution was applied to samples of cotton printcloth in the same manner as that described in Example 1. Curing time and temperature, % add-on, and WRA (W+F) are shown in Table II.

TABLE I

| Cure °C./min) | Add-On (%) | WRA (W + F) (degrees) |
|---|---|---|
| 140/2 | 5.2 | 278 |
| 150/1 | 5.5 | 272 |
| 160/0.5 | 4.9 | 277 |
| Untreated Control | — | 190 |

TABLE II

| Cure (°C./min) | Add-On (%) | WRA (W + F) (degrees) |
|---|---|---|
| 135/3 | 4.3 | 278 |
| 140/0.5 | 3.2 | 270 |
| 140/1 | 4.0 | 275 |
| 150/0.5 | 4.5 | 282 |
| 160/0.33 | 4.0 | 280 |
| Untreated Control | — | 190 |

TABLE III

| Bleaching Agent | | Stain rating |
|---|---|---|
| None | — | 3 |
| 2.5% Magnesium peroxyphthalate, | pH 6, 20° C. | 4 |
| | pH 6, 60° C. | 4–5 |
| | pH 7, 20° C. | 4 |
| | pH 8, 20° C. | 4 |
| 1.5% $NaBO_3.H_2O$ | pH 6, 60° C. | 4 |
| 1.0% $NaBO_3.H_2O$ | pH 6, 60° C. | 4 |
| 2.5% $H_2O_2$ | pH 9, 60° C. | 4 |
| 1.5% $NaBH_4$ | pH 6, 60° C. | 4–5 |
| DMDHEU-Treated Control, No Bleaching | | 4–5 |

TABLE IV

| Bleaching Agent | | Stain Rating |
|---|---|---|
| None | | 2–3 |
| 2.5% Magnesium peroxyphthalate | pH 6, 20° C. | 4–5 |
| | pH 6, 60° C. | 4–5 |
| 1.5% $NaBO_3.H_2O$ | pH 6, 60° C. | 4–5 |
| 2.5% $H_2O_2$ | pH 9, 60° C. | 4–5 |
| DMDHEU-Treated Ccntrol, No Bleaching | | 4–5 |

All of the treated samples had good WRA, which was in the range required for permanent press fabrics. All of the fabrics were yellowed by the treatment. The yellow color of the samples could be substantially removed by the same method described in Example 3. The results are shown in Table IV.

EXAMPLE 3

Fabric samples treated with DHTMB as described in Example 1 were successfully bleached with (a) magnesium peroxyphthalate in a 2.5% aqueous solution at pH 6 at about 20° C. (ambient) or 60° (pH levels were maintained by MacIlvains's buffer solution); (b) sodium perborate in a 1.5% aqueous solution at pH 6 at 60° C.; (c) hydrogen peroxide in a 2.5% aqueous solution at pH 9 at 60° C. or (d) sodium borohydride in a 1.5% aqueous solution at pH 6 at 60° C. Treatments were carried out with a 20:1 liquid-to-fabric ratio for 15 min, followed by a 5-min rinse in deionized water and air drying. Evaluation of color removal was by the AATCC gray scale for staining [AATCC Technical Manual, Vol. 62 (1987)]. Results are shown in Table III.

The control in Table III was fabric which had been treated with the typical permanent press finish, dimethloldihydroxyethyleneurea (DMDHEU). All of the bleached samples had higher stain ratings (4–5) than the DHTMB-treated samples with no bleach (3 rating), and all were equal to or nearly equal to the DMDHEU control.

EXAMPLE 4

Fabric samples treated with 3,4-dihydroxy-2,5-dimethoxytetrahydrofuran (DHMTF) were successfully bleached as described in Example 3. The stain ratings are shown in Table IV.

All of the samples had stain ratings equal to a DMDHEU-treated control, and much better than the unbleached DHMTF-treated fabric.

EXAMPLE 5

A solution was prepared by dissolving 5 parts of a commercial-grade sodium hypochlorite bleach (containing about 5.25% NaOCl) in 500 parts of water. This solution contained about 0.05% NaOCl and had a pH of about 9.9. Samples of cotton printcloth treated with DHTMB and DHMTF, respectively, were stirred in the solution for 1 min at ambient room temperature, immediately rinsed thoroughly in deionized water, and air dried. Most of the yellow color was removed from the samples.

The bleaching process was repeated in the same manner except that the solution contained about 0.1% NaOCl (pH 10.1). Fabric samples were noticeably whiter than those treated with 0.05% NaOCl bleach. The whiteness of the samples was also equal to that of samples bleached by the agents of Examples 3 and 4.

EXAMPLE 6

A dilute solution of hypochlorous acid (HOCl) was prepared by dissolving 15 parts of a commercial-grade sodium hypochlorite bleach (containing about 5.25% NaOCl) in 1000 parts of water and adjusting to a pH of about 5.5 with dilute hydrochloric acid. This solution contained about 0.056% HOCl. Samples of cotton printcloth treated with DHTMB or DHMTF were stirred in the solution for periods of ½ min, 1 min, and 2 min, respectively, at ambient room temperature. The samples were then rinsed thoroughly in deionized water and air dried. They were bleached to the same degree of whiteness as with NaOCl in Example 5 except that HOCl bleached the samples more rapidly, requiring only about 30 seconds compared to 60 seconds for NaOCl.

EXAMPLE 7

A solution of HOCl was prepared as in Example 6 except that 10 parts of commercial-grade NaOCl was dissolved in 500 parts of water and adjusted to pH 5.0. The solution contained about 0.07% HOCl. Cotton fabric samples treated with DHTMB or DHMTF were similarly bleached for 2 min. Similar results were obtained as in Example 6.

EXAMPLE 8

Example 7 was repeated except that two solutions were prepared. One was adjust to pH 6.0 and the other to pH 7.0. The fabric samples were bleached for 15, 30, and 60 seconds, respectively. DHTMB-treated samples were bleached more rapidly than the DHTMF samples, requiring 15 seconds or less. About 60 seconds was required for DHTMF to reach the same degree of whiteness.

The wrinkle recovery angles (WRA) of the treated cotton samples were largely unaffected by the bleaching process using hypochlorous acid. The results are shown in Table V.

There was a slight reduction in WRA at the lowest curing temperature of 140° C.

Similar results would be expected with NaOCl bleach at pH 9.9 to 10.1 because acetal crosslinks are known to be more stable to alkaline than to acid conditions.

EXAMPLE 9

A water soluble was prepared containing 10% glyceraldehyde diethyl acetal (GDEA), 0.4% aluminum sulfate of the formula $Al_2(SO_4)_3.16H_2O$ and 0.4 L-(+)-tartaric acid.

Samples of cotton printcloth were padded with the solution to a wet pick-up of 70–80% using a laboratory padder. The samples were then dried for 5 minutes in a forced draft oven at 85° C., and cured similarly for 1 minute at 150° C.. The fabric was then rinsed in water, oven dried, and air equilibrated. It had a weight gain of 3.0% and a wrinkle recovery angle (WRA) of 253° C. (W+F). A similar sample cured for 0.5 minutes at 160° C. had a WRA of 248° C. An untreated control sample had a WRA of 190°.

TABLE V

| Treatment | Cure °C./min | WRA (W + F) degrees before HOCl bleach | WRA (W + F) degrees after HOCl bleach | pH of HOCl |
|---|---|---|---|---|
| DHTMB | 150/1 | 272 | 277 | 5 |
| DHTMB | 160/0.5 | 262 | 262 | 5 |

TABLE V-continued

| Treatment | Cure °C./min | WRA (W + F) degrees before HOCl bleach | WRA (W + F) degrees after HOCl bleach | pH of HOCl |
|---|---|---|---|---|
| DHTMB | 140/2 | 278 | 265 | 5 |
| DHMTF | 160/0.33 | 267 | 265 | 6 |
| DHMTF | 160/0.33 | 263 | 262 | 6 |

TABLE VI

| Cure °C./min. | Add-On (%) | WRA (W + F) (degrees) |
|---|---|---|
| 125/2 | 4.3 | 226 |
| 142/0.5 | 5.4 | 232 |
| 115/2 | 3.2 | 222 |
| 115/3 | 4.3 | 231 |
| Untreated Control | | 190 |

EXAMPLE 10

A water solution of GDEA was prepared in the same manner as in Example 7 except that it contained 1% of a reactive silicone fabric softener containing silanol end groups. Five cotton printcloth samples were padded with the solution and cured at the following time and temperatures as indicated in Table VI. Weight gain (or % add-on) and WRA (warp & fill) are also shown.

The untreated control fabric had a WRA of 190°. All of the samples of Table VI show improved results.

EXAMPLE 11

A water solution was prepared containing 10% GDEA, 0.76% $Al_2(SO_4)_3.16H_2O$, 0.77% tartaric acid, 0.28% $Al(OH)_2OAc.\frac{1}{3}H_3BO_3$ as a buffer, 1% silanol softener, and 0.1% of an alkylaryl polyether alcohol [in this case a nonionic wetting agent, Triton X-100 (Rohm and Haas)]. Cotton printcloth samples were treated as in Example 9 and cured as indicated in Table VII. Percent weight gain (add-on) and WRA are also shown.

Samples shown in Table VII were dried for 5 minutes at 85° C.. When a fabric sample was dried for 2 minutes at 115° C. and cured for 1 minute at 150° C., a WRA of 245° was obtained. All of the treated samples show improvement over the control.

EXAMPLE 12

A water solution was prepared containing 10% GDEA, 0.57% $Al_2(SO_4)_3$, 2.1% L-(+)-tartaric acid, 0.35% $Al(OH)_2OAc.\frac{1}{3}H_3BO_3$, and 1% polyethylene softener instead of the silanol softener used in previous examples. Samples of cotton fabric were padded with the solution, dried 2 minutes at 115° C. and cured as indicated in Table VIII. Data on % add-on and WRA are also given.

EXAMPLE 13

A water solution was prepared containing 10% GDEA, 0.77% $Al_2(SO_4)_3$, 0.76% L-(+)-tartaric acid, 0.28% $Al(OH)_2OAc.\frac{1}{3}H_3BO_3$, and 1% silanol softener. Cotton printcloth samples were padded with the solution, dried 2 minutes at 115° C. and cured as indicated in Table IX. Data on % add-on and WRA are also given. Improvement in all samples was shown over untreated control.

TABLE VII

| Cure °C./min. | Add-On (%) | WRA (W + F) (degrees) |
|---|---|---|
| 115/3 | 3.5 | 220 |
| 115/5 | 3.5 | 222 |
| 150/1 | 3.8 | 244 |
| 160/0.5 | 4.2 | 247 |
| 160/1 | 4.4 | 254 |
| 170/0.25 | 3.3 | 251 |
| 170/0.17 | 4.2 | 273 |
| Untreated Control | | 190 |

TABLE VIII

| Cure °C./min. | Add-On (%) | WRA (W + F) (degrees) |
|---|---|---|
| 150/0.5 | 2.2 | 231 |
| 160/0.25 | 1.9 | 224 |
| 160/0.5 | 2.4 | 248 |
| Untreated Control | | 190 |

TABLE IX

| Cure °C./min. | Add-On (%) | WRA (W + F) (degrees) |
|---|---|---|
| 150/1 | 2.8 | 245 |
| 160/0.5 | 2.9 | 236 |
| 170/0.25 | 3.3 | 251 |
| Untreated Control | | 190 |

TABLE X

| Cure °C./min. | Add-On (%) | WRA (W + F) (degrees) |
|---|---|---|
| 140/2 | 2.5 | 236 |
| 150/1 | 2.5 | 226 |
| 160/0.5 | 2.1 | 225 |
| Untreated Control | | 190 |

EXAMPLE 14

A water solution was prepared containing 10% GDEA, 0.77% $Al_2(SO_4)_3.16H_2O$, 0.37% L-(+)-tartaric acid, 0.35% citric acid, and 0.28% $Al(OH)_2OAc.\frac{1}{3}H_3BO_3$. No softener was used in this formulation. This formulation differs from the preceding examples in that the catalyst activator is a combination of tartaric and citric acids. The samples were dried for 2 minutes at 115° C. Data on treated cotton printcloth samples are shown in Table X, clearly indicating improvement over untreated control.

EXAMPLE 15

In this example and the following ones, dl-glyceraldehyde dimethyl acetal (GDMA) was used instead of glyceraldehyde diethyl acetal. A water solution was prepared containing 10% GDMA, 0.77% $Al_2(CO_4)_3.16H_2O$, 0.76% L-(+)-tartaric acid, 0.28% $Al(OH)_2OAc.\frac{1}{3}H_3BO_3$, 1% silanol softener, and 0.1% Triton X-100 wetting agent. Cotton printcloth samples were padded with the solution to a wet pick-up of about 90%, dried for 5 minutes at 85° C., and cured as indicated in Table XI, clearly indicating improved values over untreated control. Data on % add-on and WRA are also given.

The WRA of the untreated control fabric was 190°. From the WRA values obtained with GDMA it is evident that GDMA is more reactive than GDEA, and therefore preferred. WRA values of 270° are within the range of those required for durable press finishes.

EXAMPLES 16

Example 15 was repeated except that the fabric was not scoured with 1% acetic acid prior to treatment. The results are shown in Table XII. From the WRA values, it is obvious that better results were obtained when the fabric was given an acid scour prior to treatment.

TABLE XI

| Cure °C./min. | Add-On (%) | WPA (W + F) (degrees) |
|---|---|---|
| 140/2 | 2.9 | 265 |
| 150/1 | 3.7 | 271 |
| 160/0.5 | 3.8 | 270 |
| 170.0.17 | 2.7 | 241 |
| Untreated Control | | 190 |

TABLE XII

| Cure °C./min. | Add-On (%) | WRA (W + F) (degrees) |
|---|---|---|
| 140/2 | 3.2 | 247 |
| 150/1 | 3.3 | 260 |
| 160/0.5 | 3.3 | 248 |
| Untreated Control | | 190 |

EXAMPLE 17

A water solution was prepared containing 10% GDMA, 1% $Al_2(OH)_5Cl.2H_2O$, 1% citric acid, and 1% polyethylene softener. A sample of cotton fabric composed of 50% cotton and 50% polyester was padded with the solution to a wet pick-up of about 65%. The fabric samples were dried for 5 minutes at 85° C. and cured as indicated in Table XIII.

The WRA of an untreated sample of cotton/polyester (50/50 blend) was 257°. From the table it can be seen that there was a significant improvement in WRA at high temperatures for very short periods of time. A curing temperature of 190° C. for about 10 seconds is preferred because a higher temperature or a longer cure time yellowed the fabric slightly.

TABLE XIII

| Cure °C./min. | Add-On (%) | WRA (W + F) (degrees) | Fabric Color |
|---|---|---|---|
| 200/0.17 | 2.5 | 299 | slight yellow |
| 190/0.17 | 2.6 | 288 | white |
| 190/0.25 | 2.9 | 296 | slightly yellow |

We claim:

1. A composition for crosslinking cellulosic material comprising: a hydroxy acetal of the structure $(RO)_2$—CH—CHOH—CHOH—$CH(OR)_2$, wherein R is alkyl and a catalyst capable of inducing a crosslinking reaction between said cellulosic material and said acetal.

2. A composition as described in claim 1, wherein said catalyst is selected from the group consisting of aluminum sulfate, aluminum chlorohydroxide, magnesium chloride, zinc nitrate, and p-toluene sulfonic acid.

3. A composition for crosslinking cellulosic material comprising: a hydroxy acetal, a catalyst capable of inducing a crosslinking reaction between said cellulose material and said acetal, and a catalyst activator.

4. A composition as described in claim 3 wherein said catalyst activator comprises an organic acid.

5. A composition as described in claim 3 wherein said catalyst activator comprises citric acid.

6. A composition as described in claim 3 wherein said catalyst activator comprises tartaric acid.

7. A process for producing wrinkle-resistant cellulosic fabric comprising: applying a hydroxy acetal of the formula:

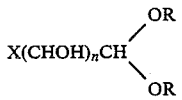

wherein R is alkyl, n is 1 to 4, and X is selected from:

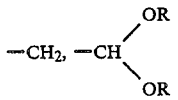

or hydrogen; or

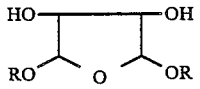

applying a catalyst to said fabric; and treating said fabric under conditions to cause crosslinking between said fabric and said acetal.

8. A process as described in claim 7 wherein said cellulosic fabric comprises cotton.

9. A process as described in claim 7 wherein said catalyst is selected from the group consisting of aluminum sulfate, aluminum chlorohydroxide, magnesium chloride, zinc nitrate, and p-toluene sulfonic acid.

10. A process for producing a wrinkle-resistant cellulosic fabric comprising: applying a hydroxy acetal, a catalyst, and a catalyst activator to said fabric; treating said fabric under conditions to cause crosslinking between said fabric and said acetal.

11. A process as described in claim 10 wherein said catalyst activator comprises an organic acid.

12. A process as described in claim 10 wherein said catalyst activator comprises citric acid.

13. A process as described in claim 10 wherein said catalyst activator comprises tartaric acid.

14. A cellulosic composition having a plurality of crosslinks selected from the structures

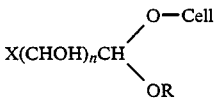

and

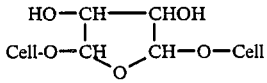

wherein "cell" is cellulose, R is selected from the group consisting of alkyl and cellulose, n is 1 to 4, and X is selected from

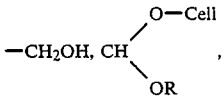

provided that when X is —$CH_2OH$ or hydrogen, R is cellulose.

15. A cellulose composition as described in claim 14 wherein R is methyl or cellulose.

* * * * *

UNITED STATES PATENT AND TRADEMARK OFFICE

CERTIFICATE OF CORRECTION

PATENT NO. : 4,900,324

DATED : February 13, 1990

INVENTOR(S) : Leon H. Chance, Gary F. Danna, and Bethlehem K. Andrews

It is certified that error appears in the above—identified patent and that said Letters Patent is hereby corrected as shown below:

Column 4, line 63, delete "by" and insert -- be -- ;
Column 4, line 64, delete "not" .
Column 7, line 49, delete "soluble" and insert -- solution -- .
Column 8, line 51, delete "$Al_2(SO_4)_3$," and insert -- $Al_2(SO_4)_3 \cdot 16H_2O$ -- ;
Column 8, line 61, delete "$Al_2(SO_4)_3$," and insert -- $Al_2(SO_4)_3 \cdot 16H_2O$ -- .

Signed and Sealed this

Sixteenth Day of July, 1991

*Attest:*

HARRY F. MANBECK, JR.

*Attesting Officer*

*Commissioner of Patents and Trademarks*